United States Patent [19]

Pfeifer

[11] 4,286,764

[45] Sep. 1, 1981

[54] MERCHANDISE HANGER ASSEMBLY

[76] Inventor: William Pfeifer, 400 Elwyn Ave., Springdale, Pa. 15144

[21] Appl. No.: 55,828

[22] Filed: Jul. 9, 1979

[51] Int. Cl.[3] ..... A47F 5/00

[52] U.S. Cl. ..... 248/220.3; 248/289.3

[58] Field of Search ..... 248/145, 214, 215, 220.3, 248/220.4, 221.1, 221.2, 222.2, 226.5, 289 A, 37.3, 37.6; 211/57.1, 59.1

[56] References Cited

U.S. PATENT DOCUMENTS

| | | | |
|---|---|---|---|
| 1,033,915 | 7/1912 | McDonald | 211/57.1 X |
| 2,291,966 | 8/1942 | Joseph | 248/215 |
| 2,665,869 | 1/1954 | Samuels | 248/226.5 X |
| 3,645,485 | 2/1972 | Gold | 211/59.1 X |
| 3,897,926 | 8/1975 | Silver | 248/221.1 |
| 3,976,201 | 8/1976 | Hodgson | 248/220.4 |

*Primary Examiner*—William H. Schultz

*Attorney, Agent, or Firm*—Parmelee, Miller, Welsh & Kratz

[57] ABSTRACT

A tag support member is mounted in a vertical bore in a hanger bracket behind the vertical bore in which a horizontally disposed hanger is resiliently mounted in a centered position such that the tag support member is cantilevered outward above the hanger. The bracket may be mounted on a perforated board or clipped onto a flat, horizontally disposed support bar set on edge. In the latter case, a projection on the lower rear edge of the bracket snaps over the support bar to firmly lock the bracket in place. Hangers may be disposed in opposite directions from a horizontal bar by a pair of hanger brackets mounted back to back with a clip in between for engaging the bar.

8 Claims, 5 Drawing Figures

MERCHANDISE HANGER ASSEMBLY

BACKGROUND OF THE INVENTION

1. Field of the Invention

This invention relates to a combination of bracket for supporting a cantilevered hanger, such as those upon which carded merchandise is hung, and a cantilevered tag holder upon which a label bearing information relating to the merchandise suspended from the hanger may be placed.

2. Prior Art

It is common practice to display carded merchandise by hanging it from horizontal hangers. The hangers are usually welded to a wire frame structure such as shown, for example, in U.S. Pat. Nos. 2,626,061 and 2,802,576, or they may be supported by brackets which are either mounted on perforated display boards as shown in commonly owned U.S. Pat. No. 3,897,926 or clipped onto horizontal bar structures. The bracket disclosed in the latter patent has met with considerable success because the hanger is resiliently mounted so that it can be deflected sideways to reduce the occurrence or severity of personal injuries to those unwittingly coming into contact with the hanger, yet the hanger will be centered again when contact terminates.

It has been found useful to provide tag holders upon which sales or inventory information relating to the carded merchandise can be placed. Thus, U.S. Pat. No. 2,626,061 discloses a vertical panel for this purpose located at the rear of a structure supporting two wire hangers. Where there are a number of hangers close together and/or the hangers are very long, it is not practical to place the tags at the rear of the hangers. Thus, U.S. Pat. No. 2,802,576 suggests cantilevering one long tag holder out over a row of hangers with wires welded to the rear of the supporting structure. In another approach, U.S. Pat. No. 4,013,252 suggests that the upturned end of the hanger be flattened to provide a place for attaching a label. This patent, together with U.S. Pat. No. 4,104,817, also suggests that indications can be provided along the length of the hanger shank of the amount of merchandise remaining on the hanger, which is useful in inventory control.

The object of the present invention is to provide improved means for displaying information related to carded merchandise hung from hangers which are resiliently mounted in brackets to reduce the possibility of injury to those coming into inadvertent contact with the hanger.

It is also an object of the invention to provide such information displaying means without interfering with the normal stocking and removal of merchandise from the hanger.

It is a further object of the invention to provide a hanger bracket having integral means for supporting the means for displaying the information.

SUMMARY OF THE INVENTION

In accordance with the invention, a hanger member with an elongated shank and a base portion of circular cross-section at right angles to the shank, and a tag support member having an elongated shaft with means for displaying information located at one end of the shaft and a base portion of noncircular cross-section extending at right angles from the other end of the shaft are supported through their base portions by a common bracket. The bracket comprises a body member having a planar rear surface and an upper surface. A first bore of circular cross-section extending vertically downward into the body from the upper surface receives the base portion of the hanger member. Resilient centering means integral with the body bear against the sides of the shank of the hanger member for returning the hanger member to a center position wherein the shank extends forward at substantially a right angle to the planar rear surface of the body whenever displaced laterally therefrom. A second bore having a noncircular cross-section corresponding to that of the base of the tag support member extends vertically downward into the body member between the first bore and the planar rear surface with the second bore just intersecting the first bore. The second bore is of such a depth that with the base of the tag support member inserted in the second bore, the shaft of the tag support member extends substantially parallel to and spaced above the shank of the hanger member. Preferably, the shaft of the tag support member is shorter than the shank of the hanger member so that the hanger member extends outward beyond the tag support member.

With this combination, information about the merchandise hung on the hangers can be conveniently displayed so that it is clearly identified with the goods on a particular hanger, yet the tag support member does not interfere with the normal use of the hanger or the resilient mounting of the hanger. In addition, the tag support member and the hanger are both supported by a simple, easily molded one piece bracket that can be adapted to attach the assembly to either a perforated display board or a horizontal support bar.

For supporting the hanger bracket from a flat horizontally disposed support bar set on edge, the bracket is provided with an integral, resilient clip member extending rearwardly from the top of the body member and downwardly parallel to, and across a substantial portion of the width of, but spaced from, the rear planar surface of the body by a distance slightly less than the thickness of the flat support bar. An integrally formed projection extending from the lower edge of the planar rear surface of the body member snaps over the lower edge of the flat support bar when the clip is placed on the bar. This arrangement securely fastens the hanger to the support bar.

A double hanger bracket is also provided for supporting hangers, each with its own tag support member, from opposite sides of a flat, horizontal support bar. In this arrangement, the bracket includes a second body member formed integrally with the clip member and extending outwardly in a direction diametrically opposite the first body member. This second body member has first and second bores similarly disposed as those in the first body member for receiving the second hanger member and tag support member and for supporting them such that they extend outward in the opposite direction from the support bar from the first hanger and tag support members.

DESCRIPTION OF THE PREFERRED EMBODIMENTS

Figure 1:
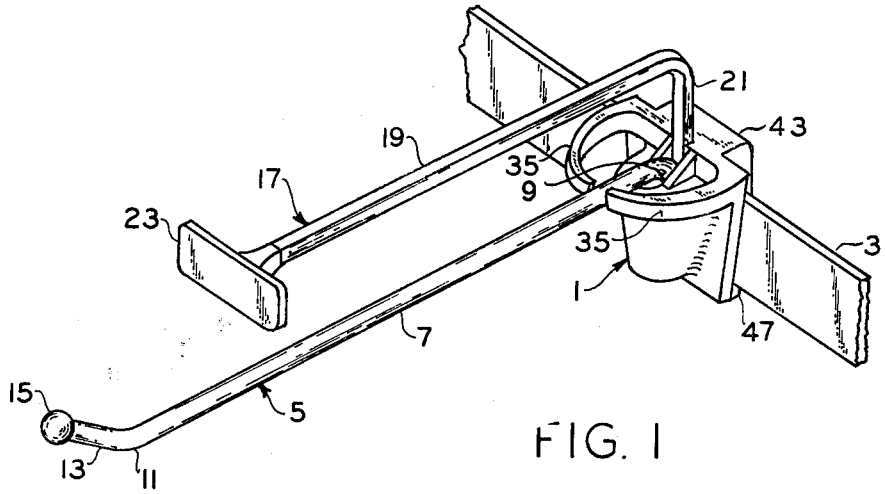
FIG. 1 is a front isometric view of a hanger bracket with a hanger and tag supporting member in place and mounted on a horizontal support bar, all in accordance with the teachings of the invention.

FIG. 1 illustrates a hanger bracket 1 according to the invention clipped onto a flat, horizontally disposed support bar 3 which is set on edge. The bracket 1 supports a hanger 5 having an elongated shank portion 7 and a base portion 9 of circular cross-section depending at substantially a right angle from one end of the shank portion. The free end of the hanger 5 may be bent upward as at 11 to form a hook portion 13 which is provided with a spherical enlargement 15 at its extremity. The resilient sleeve 11 serves to minimize the extent of injury which might occur from accidental contact with the tip of the hanger.

The hanger 1 also supports a tag support member 17 having an elongated shaft 19 and a base portion 21 of noncircular cross-section depending at a right angle from one end of the shaft 19. The free end of the shaft 19 is fitted with a tag holder 23. This tag holder may be of any configuration suitable for displaying or holding information concerning merchandise to be hung from the hanger 5. For instance, labels bearing descriptive and/or pricing information could be pasted on the tag holder or placed on a card held in slots on the tag holder. On the other hand, the tag holder could be made of magnetic material upon which coded inventory information could be stored for reading by a scanning device. Alternatively, the inventory information could be printed on a label held by the tag holder for reading by an optical scanner. It should be clear that various kinds of information or combinations of information can be displayed in various ways on the tag holder for one or more purposes.

Figure 2:
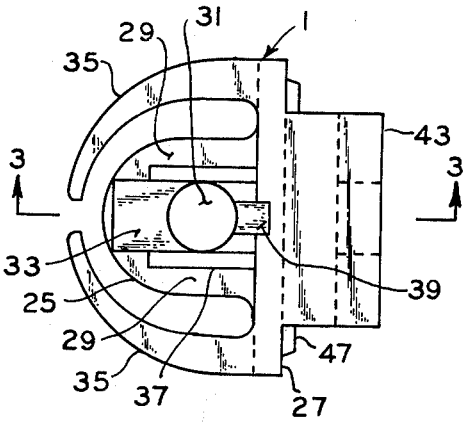
FIG. 2 is a plan view of the bracket of FIG. 1 with the hanger and tag supporting member removed.
Figure 3:
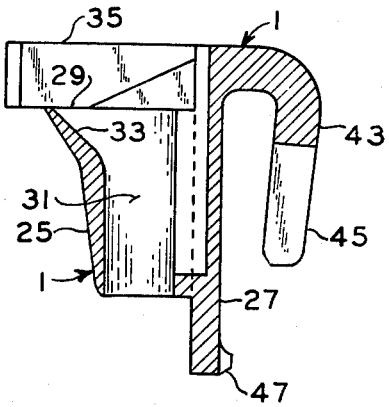
FIG. 3 is a vertical sectional view taken along the line III—III in FIG. 2.

As seen from FIGS. 1 through 3, the hanger bracket 1 has a body member 25 with a planar rear surface 27 and a top surface 29. A first bore 31 extends vertically downward from the upper surface through the body 25. This bore, which has a circular cross-section, receives the circular base portion 9 of the hanger. The bore 31 is relieved as at 33 to accommodate the curvature of the hanger 5 between the shank 7 and base portion 9.

A pair of integral, laterally spaced resilient arms 35 extend forward from the upper portion of the body 25 of the bracket and curve inward to bear against the sides of the shank 7 of the hanger when the base 9 is inserted into the bore 31. Due to the resilience of these arms, the hanger is centered in relation to the hanger bracket and is returned to the centered position if deflected. Inclined surfaces 37 extending upward and rearward along side the bore 31 assist in centering the hanger.

The body 25 of the bracket is also provided with a second bore 39 which extends vertically downward between the first bore 31 and the planar rear face 27. This bore which receives the base portion 21 of the tag support member, has a noncircular cross-section matching that of the base portion 21 such that the tag support member is held firmly in a centered position. The bore 39 does not extend all the way through the body 25 such that the end of the base portion 25 bears against the surface 41 at the bottom of bore 39 to position the shaft 19 of the tag support member vertically above the shank 7 of the hanger. The bore 39 which is parallel to the bore 31 may partially intersect the first bore, thereby minimizing the depth of the body 25 and facilitating molding of the same.

For mounting the bracket 1 to the support bar 3, a clip member 43 extends from the top rear of the body 25 rearwardly and downwardly parallel to but spaced from the rear planar surface 27 by a distance slightly less than the thickness of the flat support bar. The downwardly extending portion of the clip 43 may be split into two legs 45. An integral projection 47 with cammed surfaces extends across the lower edge of the planar rear surface 27 and snaps over the lower edge of the horizontal support member to lock the bracket to the bar.

Figure 4:
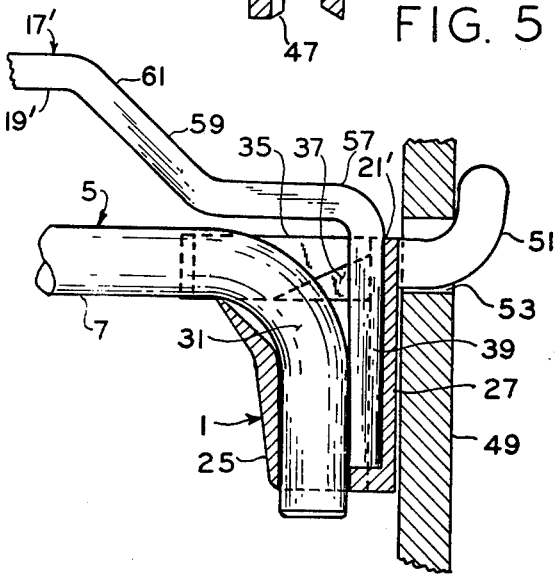
FIG. 4 is a vertical sectional view through a bracket according to the invention adapted for use with a perforated board.

FIG. 4 illustrates another embodiment of the invention adapted for mounting the bracket on a perforated board 49. In this bracket, a pair (only one shown in FIG. 4) of laterally spaced, integral lugs 51 extend rearwardly and then upwardly from the upper rear of the body 25. These lugs 51 extend through holes 53 in the perforated board 49 to secure the bracket in place. The remaining features of the bracket are the same as in the bracket of FIGS. 1 through 3. With this arrangement the bracket 1 is installed in the perforated board 49 by holding the bracket with the planar rear surface 27 horizontal and inserting the ends of the lugs 51 into the perforations 53 in the board 49. The bracket 1 is then rotated to the position shown in FIG. 4. In order for the bracket to be so rotated with the tag support member 17′ in place, an intermediate portion thereof extends forward from the base portion 21′ just above the shank 7 of the hanger member as at 57 and then diagonally upward as at 59 to the shaft 19′ of the tag support member. With this arrangement, the inner end 61 of the shaft of the tag support member is offset from the planar rear surface 27 of the bracket such that the bracket with the hanger member 5 and tag support member 17′ installed can be inserted or removed from perforated panel 49 as a unit.

Figure 5:
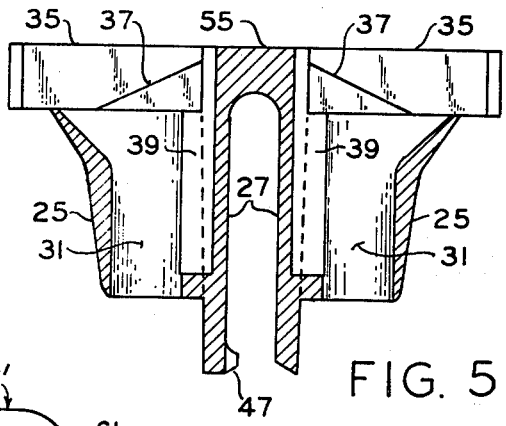
FIG. 5 is a vertical sectional view through another bracket according to the invention adapted for supporting two hangers such with their own tag supporting member extending outward in opposite directions from a horizontally disposed support bar.

FIG. 5 illustrates a double bracket made according to the teachings of the invention. In this configuration, two body members 25 are placed back to back and joined by an integral resilient portion 55 which forms a clip with the planar rear walls 27. The double bracket is locked onto a horizontal support bar by the integral projection 47 extending along the lower edge of one planar rear wall. With this arrangement, two hangers, each with its own tag support member, extend outward in opposite directions from a single support bar thereby maximizing the use of available space.

I claim:

1. In combination, a hanger member comprising an elongated shank and a base portion of circular cross-section depending at substantially a right angle from one end of the shank, a tag support member comprising an elongated shaft having means at one end for displaying information related to merchandise to be hung from the hanger member and having a base portion of noncircular cross-section depending at substantially a right angle from the opposite end of the shaft, and a bracket comprising a body member having a planar rear surface and an upper surface, a first bore of circular cross-section extending vertically downward into said body member from said upper surface for receiving the base portion of said hanger member, resilient centering means integral with said body member bearing against the sides of the shank of the hanger member for returning the hanger member to a center position wherein the shank extends forward at substantially a right angle to the planar rear surface of the body member whenever displaced laterally therefrom, and a second bore having a noncircular cross-section corresponding to that of the base of the tag support member extending vertically downward into said body member from said upper surface between said first bore and said planar rear surface, said second bore being of such a depth that with the base of the tag support member inserted in the second bore, the shaft extends substantially parallel to and spaced above the shank of the hanger member.

2. The combination of claim 1 wherein the elongated shaft of the tag support member is shorter than the shank of the hanger member.

3. The combination of claim 1 wherein said tag support member includes an intermediate portion between the shaft and said base portion, said intermediate portion extending angularly from the base portion just above the upper surface of the bracket body upward and away from the planar rear surface of the bracket to offset said opposite end of the shaft of the tag member from the planar rear surface of the bracket.

4. The combination of claim 3 in which said bracket is adapted to be mounted to a subtantially vertical perforated panel by a pair of spaced apart lugs which extend outward perpendicular to the upper portion of the planar rear surface of said bracket and then curve upward such that said bracket is secured to the perforated panel by inserting the ends of the lugs in holes in the perforated panel and rotating the bracket until the planar surface bears against the substantially vertical panel, said intermediate portion of said tag support member extending forward from the base portion of the tag support member just above and parallel to the shank of the hanger member and then diagonally upward to said opposite end of the tag support member shaft spaced above and extending parallel to said hanger member such that the bracket may be installed in and removed from the perforated vertical panel as an integral unit with the tag support member already inserted in said second bore.

5. A hanger bracket for use in connection with a hanger member comprising an elongated shank and a base portion of circular cross-section depending at substantially a right angle from one end of the shank, and a tag support member comprising an elongated shaft having means at one end for displaying information related to merchandise to be hung from the hanger member and having a base portion of noncircular cross-section depending at substantially a right angle from the opposite end of the shaft;

said bracket comprising a body member having a planar rear surface and an upper surface, a first bore of circular cross-section extending vertically downward into said body member from said upper surface for receiving the base portion of said hanger member, resilient centering means integral wth said body member bearing against the sides of the shank of the hanger member for returning the hanger member to a center position wherein the shank extends forward at substantially a right angle to the planar rear surface of the body member whenever displaced laterally therefrom, and a second bore having a noncircular cross-section corresponding to that of the base of the tag support member extending vertically downward into said body member from said upper surface between said first bore and said planar rear surface, said second bore being of such a depth that with the base of the tag support member inserted into the second bore the shaft extends substantially parallel to and spaced above the shank of the hanger member.

6. The hanger bracket of claim 5 wherein the second bore at least partially intersects said first bore.

7. The hanger bracket of claim 5 adapted for connection to a flat, horizontally disposed support bar set on edge, including an integrally formed resilient clip member extending rearwardly from the top of the body member and downwardly parallel to, and across a substantial portion of the width of, but spaced from, the rear planar surface of the body member by a distance slightly less than the thickness of the flat support bar, and an integrally formed projection extending along the lower edge of the planar surface which snaps over the lower edge of the flat support bar when the clip is placed on the flat support bar.

8. The hanger bracket of claim 5 adapted for use with a second hanger member and a second tag support member including a second body member formed integrally with said clip member and extending outward in a direction diametrically opposite the first body member, said second body member having first and second bores similarly disposed as the first and second bores in the first body member for receiving the second hanger member and tag support member respectively and for supporting them such that they extend outward in the opposite direction from the first hanger member and tag support member.

* * * * *